US011759672B2

(12) United States Patent
Rainis et al.

(10) Patent No.: US 11,759,672 B2
(45) Date of Patent: Sep. 19, 2023

(54) TREADMILL

(71) Applicant: Landice Inc., Randolph, NJ (US)

(72) Inventors: David Rainis, Mendham, NJ (US); Kevin Short, La Grange, IL (US); Skye Li, Hong Kong (CN)

(73) Assignee: Landice, INC., Randolph, NJ (US)

( * ) Notice: Subject to any disclaimer, the term of this patent is extended or adjusted under 35 U.S.C. 154(b) by 370 days.

(21) Appl. No.: 17/345,046

(22) Filed: Jun. 11, 2021

(65) Prior Publication Data

US 2022/0395721 A1 Dec. 15, 2022

(51) Int. Cl.
*A63B 22/02* (2006.01)

(52) U.S. Cl.
CPC ..... *A63B 22/02* (2013.01); *A63B 2210/50* (2013.01)

(58) Field of Classification Search
CPC ..... A63B 22/02; A63B 2210/50; A63B 2071/0683; A63B 2225/50; A63B 2225/685
See application file for complete search history.

(56) References Cited

U.S. PATENT DOCUMENTS 6,494,814 B1 * 12/2002 Wang ..... A63B 22/02 482/54
7,789,807 B1 * 9/2010 Wang ..... A63B 22/0235 482/52
2004/0058785 A1 * 3/2004 Wu ..... A63B 22/0235 482/54
2004/0116255 A1 * 6/2004 Chen ..... A63B 22/02 482/54
2005/0164840 A1 * 7/2005 Chen ..... A63B 22/02 482/54
2007/0066448 A1 * 3/2007 Pan ..... A63B 22/0235 482/54
2009/0005224 A1 * 1/2009 Davis ..... A63B 22/0257 482/54
2009/0042698 A1 * 2/2009 Wang ..... A63B 22/02 482/54
2009/0111666 A1 * 4/2009 Wang ..... A63B 22/0235 482/54
2009/0124465 A1 * 5/2009 Wang ..... A63B 22/0235 482/54
2009/0239716 A1 * 9/2009 Wang ..... A63B 22/0235 482/54
2009/0280964 A1 * 11/2009 Chen ..... A63B 22/02 482/54
2010/0029444 A1 * 2/2010 Lo ..... A63B 22/0257 482/54

(Continued)

*Primary Examiner* — Andrew S Lo
(74) *Attorney, Agent, or Firm* — Mitchell J. Mehlman, Esq.

(57) ABSTRACT

A treadmill having rapid assembly and safe storage features is provided. The treadmill includes a support base, a platform, a pair of upright arms, and a top assembly including a bridge connected to an upper and a lower handrail, the lower handrail includes a bottom portion having pivot flanges, each pivot flange has a first aperture therethrough and a bracket has a second aperture therethrough. A second pivot fastener is installed to connect and attachment tang on the upright arms with the pivot flange of the top assembly. The upright arms and the top assembly can each be rotated a predetermined angle for fixed installation of the upright arms and top assembly with respect to the long axis and platform.

20 Claims, 11 Drawing Sheets

(56) References Cited

U.S. PATENT DOCUMENTS

| | | | | |
|---|---|---|---|---|
| 2010/0240497 | A1* | 9/2010 | Wu | A63B 22/0235 482/54 |
| 2011/0021323 | A1* | 1/2011 | Wu | A63B 22/0235 482/54 |
| 2013/0203560 | A1* | 8/2013 | Wang | A63B 22/0235 482/54 |
| 2013/0237381 | A1* | 9/2013 | Chen | A63B 22/02 482/54 |
| 2013/0237383 | A1* | 9/2013 | Chen | A63B 22/02 482/54 |
| 2015/0051051 | A1* | 2/2015 | Liu | A63B 22/02 482/54 |
| 2015/0087483 | A1* | 3/2015 | Liu | A63B 22/02 482/54 |
| 2015/0209610 | A1* | 7/2015 | Dalebout | A63B 71/0622 482/54 |
| 2017/0056712 | A1* | 3/2017 | Johnson | A63B 21/4035 |
| 2017/0120102 | A1* | 5/2017 | Chen | A63B 71/0054 |
| 2020/0215380 | A1* | 7/2020 | Xing | A63B 22/025 |
| 2021/0275860 | A1* | 9/2021 | Tseng | A63B 21/4035 |
| 2022/0126165 | A1* | 4/2022 | Tsai | A63B 22/02 |
| 2022/0395721 | A1* | 12/2022 | Rainis | A63B 22/02 |

* cited by examiner

TREADMILL

FIELD OF THE INVENTION

The present invention is generally directed to the technical field of exercise, physical fitness and physical therapy equipment and more specifically to novel treadmill machines designed to be easily and quickly set up and stored safely by a user without the need for complex tools or a time-consuming assembly or disassembly process.

BACKGROUND OF THE INVENTION

Exercise, physical fitness and physical therapy equipment and machines are available in many configurations for various purposes. The majority of equipment concentrate either on an aerobic or anaerobic workout or on areas of the body such as the legs, the hips and lower torso, the chest and upper torso, the back, the shoulders and the arms.

Exercise treadmills are well known and are used for walking or running aerobic-type exercises, and diagnostic and therapeutic purposes. The person on the exercise treadmill normally can perform an exercise routine at a relatively steady and continuous level of physical activity or at a variable level of physical exercise including varying both the speed and incline of the treadmill during a single session.

Exercise treadmills typically have an endless running surface extending between and movable around rollers or pulleys at each end of the treadmill. The running surface generally is s rubber-like material driven by a motor rotating one of the rollers or pulleys. The speed of the motor is adjustable by the user or by a computer program so that the level of exercise can be adjusted to simulate running or walking.

Many current exercise treadmills, especially the middle to upper level of exercise treadmills, also have the ability to provide a variable incline to the treadmill. The incline is accomplished in one of two manners—either the entire apparatus is inclined or just the walking and running surface is inclined. An inclination takes advantage of the fact that the exercise effort, or aerobic effect, can be varied with changes in inclination, requiring more exertion on the part of the user when the inclination is greater.

Typically, a treadmill arrives in a box that includes multiple, large sub-assemblies that must be put together onsite. The assembly process can require assembling numerous sub-assemblies and dozens of components such as bolts, screws, nuts and the like. Parts can be lost in shipping, or missing from the box causing inconvenience and wasted time to acquire all parts from the manufacturer. Further, the assembly process can take hours and may require specialized mechanical skills.

In addition, many treadmills cannot be easily folded or stored without complex and time-consuming disassembly. Once folded or stored, some treadmills can be a danger to the user.

Therefore, there is a need for improved treadmill assemblies that arrive almost fully assembled and only require minimal time and parts to achieve a final assembled position. Further, there is a need for improved treadmills that include mechanisms for rapid storage in a safe configuration to prevent injury to a user.

SUMMARY OF THE INVENTION

The present invention resides in one aspect in a treadmill having convenient and safe rapid assembly mechanisms. A support base includes pair of first support members and at least one crossmember disposed between the first support members. The first support members include a first plurality of apertures and a first pivot aperture. A platform has second support members for supporting a belt. The belt can be driven by a controllable motor. The platform has one of more feet attached thereto and a longitudinal axis A. The treadmill includes a pair of upright arms. Each arm has a distal end and a proximal end. The distal end can be attached to a third support member and a pivot bracket having a flanged portion. The flanged portion includes a second plurality of apertures and a second pivot aperture. The first and second pivot apertures can be aligned to house a first pivot fastener therethrough thus forming a pivot joint between the first support members and the upright arms. The pivot joint allows for rotation of the upright arms though a predetermined angle θ and for installation of a plurality of fasteners through the aligned first and second plurality of apertures. The proximal end of the upright arms includes a tang and an attachment aperture therethrough. The treadmill includes a top assembly having a bridge connected to an upper and a lower handrail, an ergo bar, a central minipod assembly, and a control console The lower handrails include a bottom portion having pivot flanges. Each pivot flange has a first aperture therethrough and a bracket having a second aperture therethrough. A second pivot fastener is installed to connect the attachment tang of the upright arms with the pivot flange of the top assembly thus allowing the top assembly to be rotated through a predetermined angle θ1 for fixed installation of the top assembly.

In one embodiment, the angle θ is between about 42 degrees and about 62 degrees.

In some embodiments, the angle θ is about 52 degrees.

In certain embodiments, the angle θ1 is between about 80 degrees and about 100 degrees.

In some embodiments, the angle θ1 is about 90 degrees.

In certain embodiments, the treadmill can include a phone holder. The phone holder has a phone rest, and a rectangular clip. The clip is connected to an elastic member. The elastic member can be anchored and retained in a recess. A phone or a tablet can be releasably retained by the elastic members between the rectangular clip and the phone rest.

In some embodiments, the treadmill can include a cylinder assembly. The cylinder assembly can be pivotally attached to a support base crossmember and a bed assembly crossmember. The cylinder assembly includes a release pin connected to cable. The cable can be actuated by depressing a pedal to translate the release pin and thereby cause the cylinder assembly to expand and to raise a bed assembly to a storage configuration.

In yet other embodiments, the treadmill can include a safety collar. The safety collar has an aperture sized to fit on the lower handrail. The collar includes a box portion having at least one chamber, and a stop including a cylindrical portion and a finned portion. The safety collar can be installed on to the handrail such that the stop interferes with and prohibits movement or collapse of the bed assembly while in the storage configuration.

In some embodiments, a first safety collar is installed on a right lower handrail and a second safety collar is installed on a left lower handrail.

The present invention resides in another aspect includes a method of treadmill assembly and storage. The method includes the steps of: placing a preassembled support base including a pair of first support members and at least one crossmember disposed between the first support members, the first support members including a first plurality of apertures and a first pivot aperture, the support base being connected to a platform including second support members for supporting a belt, the belt being driven by a controllable motor, the platform having one of more feet attached thereto and a longitudinal axis A; rotating a pair of upright arms though a predetermined angle θ, each arm having a distal end and a proximal end; the distal end being attached to a third support member and a pivot bracket including a flanged portion, the flanged portion including a second plurality of apertures and a second pivot aperture, wherein the first and second pivot apertures are aligned to house a first pivot fastener therethrough thus forming a pivot joint between the first support members and the upright arms; installing of a plurality of fasteners through the aligned first and second plurality of apertures; the proximal end of the upright arms including a tang and an attachment aperture therethrough; and rotating a top assembly through a predetermined angle θ1, the top assembly including a bridge connected to an upper and a lower handrail, an ergo bar, a central minipod assembly and a control console, the lower handrails including a bottom portion having pivot flanges, each pivot flange having a first aperture therethrough and a bracket having a second aperture therethrough, wherein a second pivot fastener is pre-installed to connect the attachment tang of the upright arms with the pivot flange of the top assembly thus allowing the top assembly to be rotated for fixed installation of the top assembly.

In some embodiments of this aspect, the angle θ is between about 42 degrees and about 62 degrees.

In other embodiments, the angle θ1 is between about 80 degrees and about 100 degrees.

In a particular embodiment, the angle θ is between about 42 degrees and about 62 degrees and the angle θ1 is between about 80 degrees and about 100 degrees.

In some embodiments, the method further including the step of a releasably retaining a phone or a tablet in phone holder, the phone holding having a phone rest, and a rectangular clip connected to an elastic member, the elastic member being anchored and fit in a recess. A phone or a tablet can be releasably retained by the elastic members between the rectangular clip and the phone rest.

In certain embodiments the method further including the step of raising a bed assembly to a storage configuration using a cylinder assembly, the cylinder assembly being pivotally attached to a support base crossmember and a bed assembly crossmember, the cylinder assembly includes a release pin connected to cable. The cable can be actuated by depressing a pedal to translate the release pin and causing the cylinder assembly to expand and raise the bed assembly to a storage configuration.

In other embodiments, the method further includes the step of installing a safety collar, the safety collar has an aperture sized to fit on the lower handrail, a box portion having at least one chamber, and a stop having a cylindrical portion and a finned portion. The safety collar can be installed on the handrail such that the stop interferes with and prohibits movement or collapse of the bed assembly while in the storage configuration.

In some embodiments of the method, a first safety collar is installed on a right lower handrail and a second safety collar is installed on a left lower handrail.

In other embodiments, the method further includes the step of lowering the bed assembly to a user ready assembled configuration by allowing the cylinder assembly to contract thereby lowering the bed assembly to the assembled configuration.

In other embodiments, the method further includes the step of removing the safety collar and lowering the bed assembly to a user ready assembled configuration by allowing the cylinder assembly to contract thereby lowering the bed assembly to the user ready assembled configuration.

DETAILED DESCRIPTION OF THE INVENTION

Figure 1:
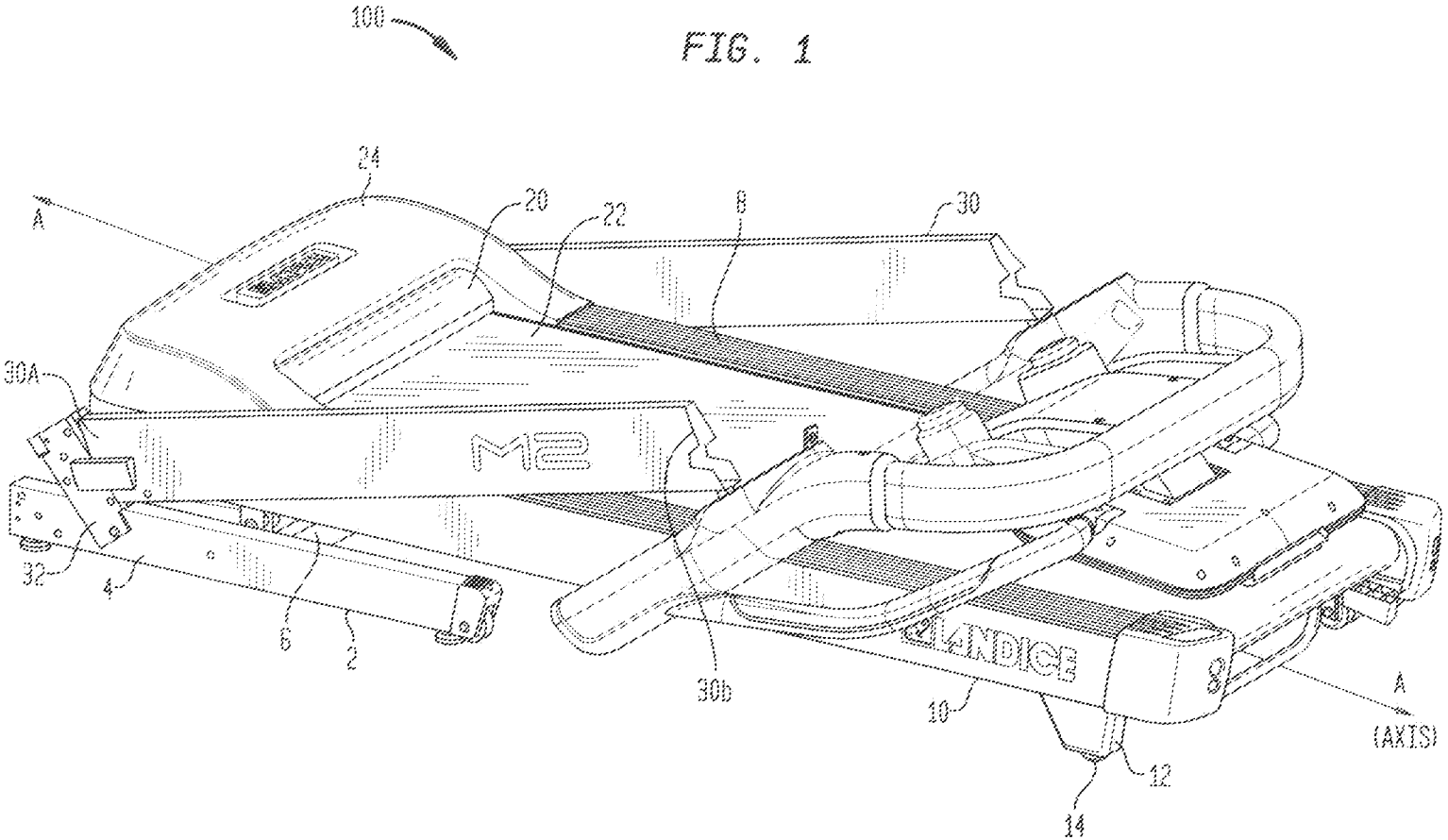
FIG. 1 is an isometric view of a treadmill shown in a shipping configuration in accordance with one embodiment of the present invention.
Figure 2:
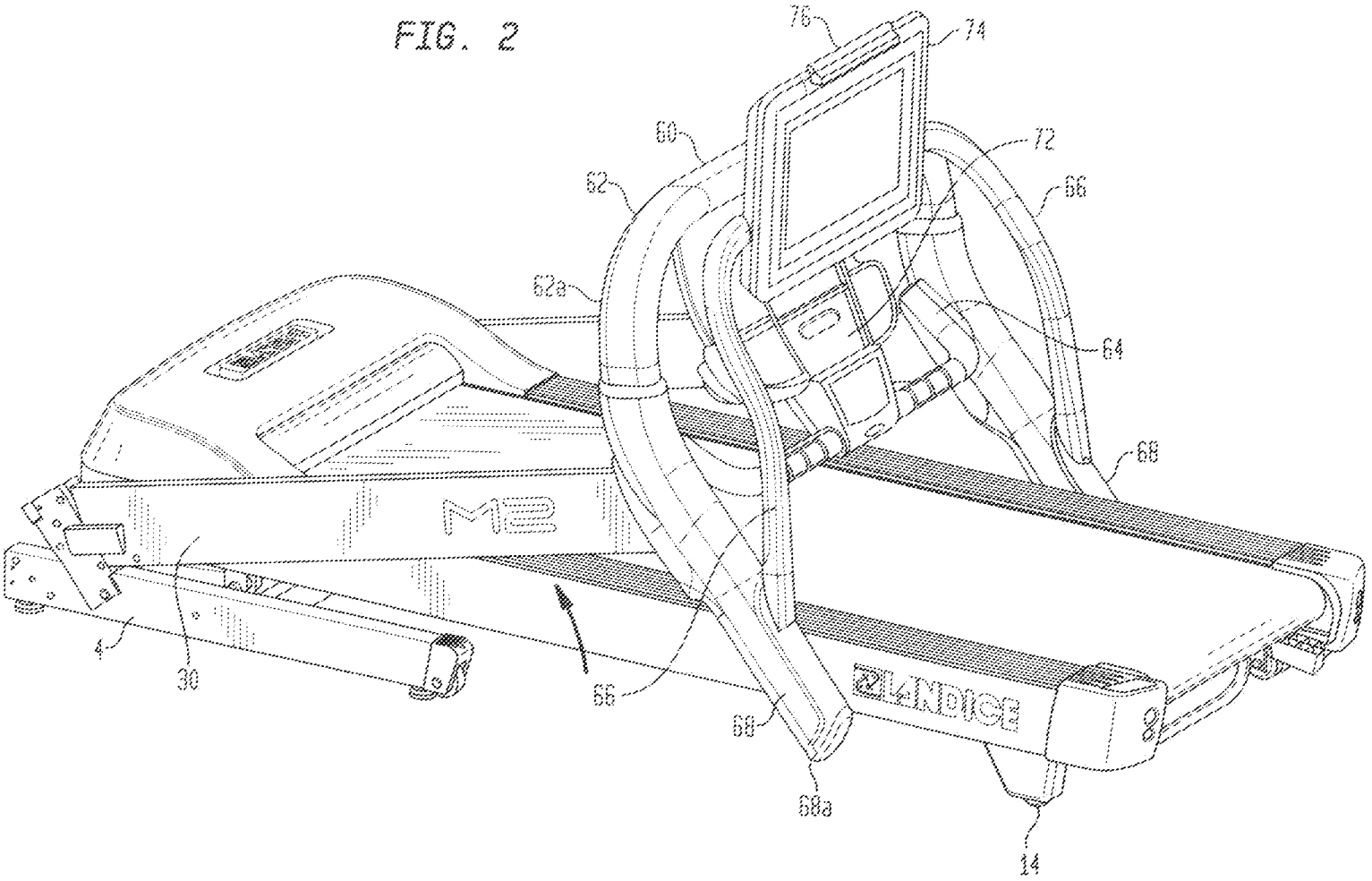
FIG. 2 is another isometric view of some of the elements of the treadmill shown in FIG. 1.

As shown in FIGS. 1-4, a treadmill in a preassembled, folded or shipping configuration is shown and is generally designated by the reference numeral 100. The treadmill 100 includes a support base 2. The support base 2 is generally configured as an H having two longitudinal members 4 each being connected to at least one crossmember 6. In the folded, shipping condition, support base 2 is substantially parallel to the long axis (A) of the treadmill 100 for placement on the ground for use.

The support base 2 is mounted to the platform 8. The platform 8 includes longitudinal members 10 extending the length of the platform 8. Feet 12 are mounted to the bottom of the platform 8. The feet can include wheels or rollers 14. Motor 20 located under motor cover 24 is for controlling and driving a treadmill belt 22 is mounted within the platform 8. The treadmill assembly 100 can include wheels or rollers 14 at any number of contact points with the ground for ease of transport and storage as discussed below.

Upright support arms 30 are pivotally mounted to support base 2 at the distal end 30A with pivot brackets 32 Pivot brackets 32 include opposing flanges 34 (see e.g., FIG. 4A-4*b*) which straddle the support base members 4. The flanges 34 and the support base members 4 include a colinear aperture (not shown) through which a pivot fastener 36 can be installed before or after shipping. The upright arms 30 can be rotated about the pivot fasteners 36 thereby moving the flanges 34 into position straddling the support members 4. A spring-loaded pin 39 can extend from the support member 4. When the upright arms 30 are rotated, the pin 39 engages a matching aperture 39A in the flange so that the flange 34 reversibly locks in place and can be easily disassembled by depressing the pin 39 when required. Predrilled, pre-aligned apertures 40, 42 in the support base 4 and the flanges 34 can now be used to install fasteners 38 such as for example, screws. Support member 44 which is attached to the upright arm 30 assists in stiffening the flange 34, aligning the upright arms 30 in the proper position, and stabilizing the arms 30 with respect to the base 2 in an assembled configuration.

The treadmill assembly 100 includes top assembly 60 having a bridge 62 including a bottom surface 62A, an ergo bar 64, left and right upper hand rails 66, and left and right lower handrails 68. Cup holder and mini pod assembly 72 is attached between the bridge 62 and the ergo bar 64. Control console 74 can be mounted to the cup holder and mini pod assembly 72. A phone holder slot 76 can be included in the control console 74. The upper hand rails 66 hand rails are connected to the console 74 thereby allowing the user to hold on as the incline of the belt 22 changes and to allow the user to attain a comfortable position. The angle between the upper hand rails 66 and the lower handrails 68 can be between about 20 degrees and about 60 degrees.

Figure 3B:
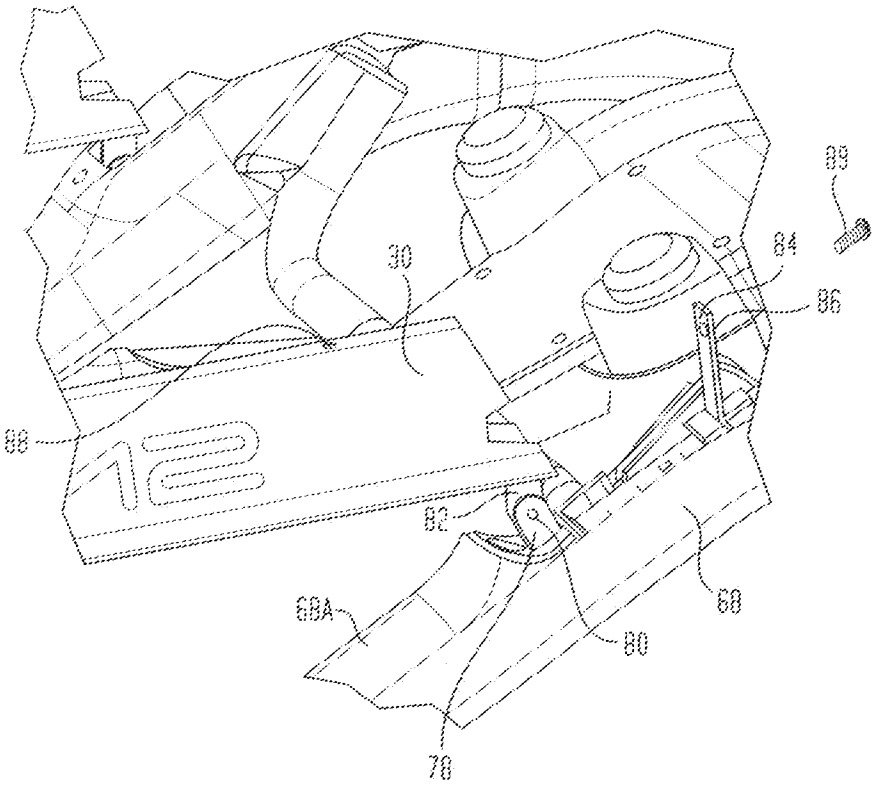
FIG. 3B is another detail of some of the elements of the treadmill shown in FIG. 1.
Figure 3A:
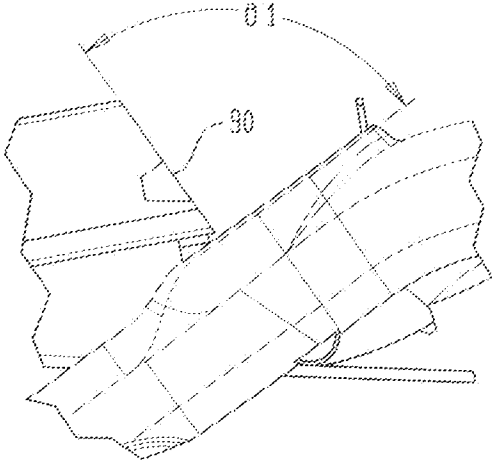
FIG. 3A is a detail of some of the elements of the treadmill shown in FIG. 1.
Figure 4A:
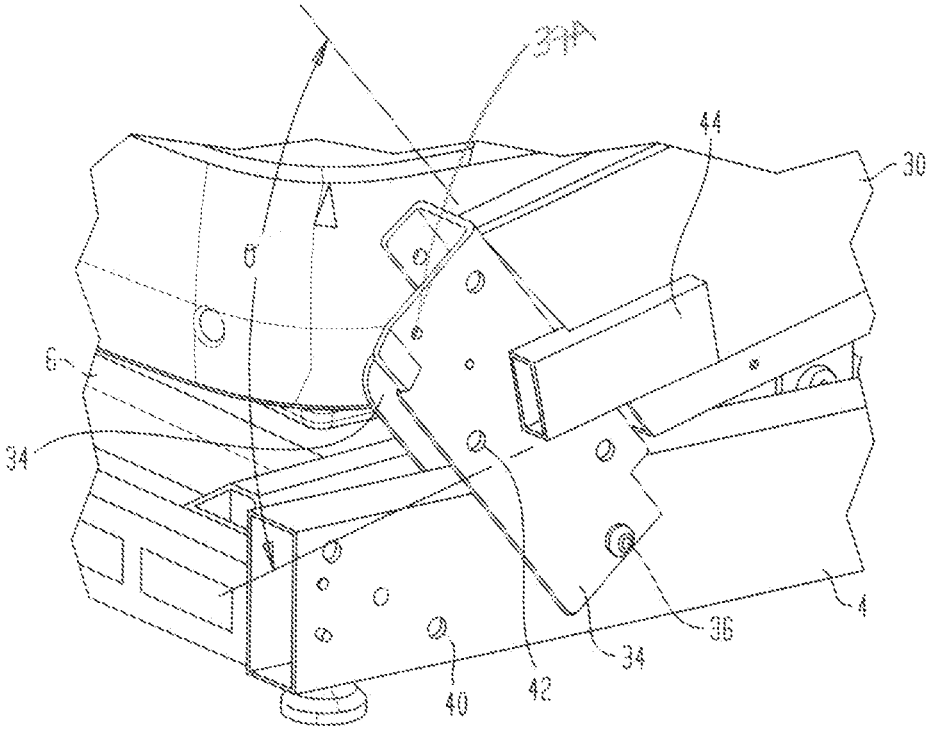
FIG. 4A is a detail of some of the elements of the treadmill shown in FIG. 1.
Figure 4B:
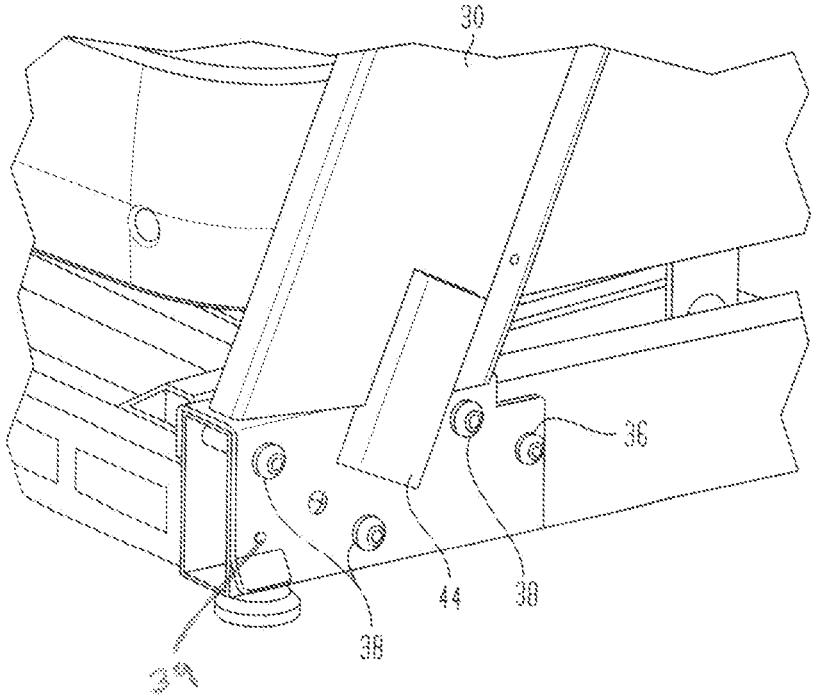
FIG. 4B is another detail of some of the elements of the treadmill shown in FIG. 1.

In the storage configuration, the top assembly 60 is mounted such that it can be rotated about 90 degrees with respect the upright arms 30 and secured thereto. As shown in FIGS. 3A and 3B, the lower handrails 68 include pivot flanges 78 including a central aperture 80 therethrough. The proximal end of upright arms 30 also include a complementary pivot tang 82 having a central aperture (not shown). The tang 82 and flanges 78 can be shipped in an aligned or fastened condition including a pivoting fastener (not shown). The lower handrails also include an alignment and securing bracket 84 having a predrilled aperture 86 for alignment with a matching predrilled aperture 88 in the upright arm 30. In the preassembled, folded, or shipping configuration, the angle θ between the beveled end 90 of upright arm 30 and the bottom surface 68A of lower handrail 68 is about 90 degrees.

For ease of assembly, a user can easily rotate the top assembly 60 about the pivot tang 82 about 90 degrees such that predrilled apertures 86 and 88 are aligned. A fastener 89 used to secure the top assembly 60 to the upright arms 30 which can also be rotated into position with respect to the base 2 as described above.

Figure 5:
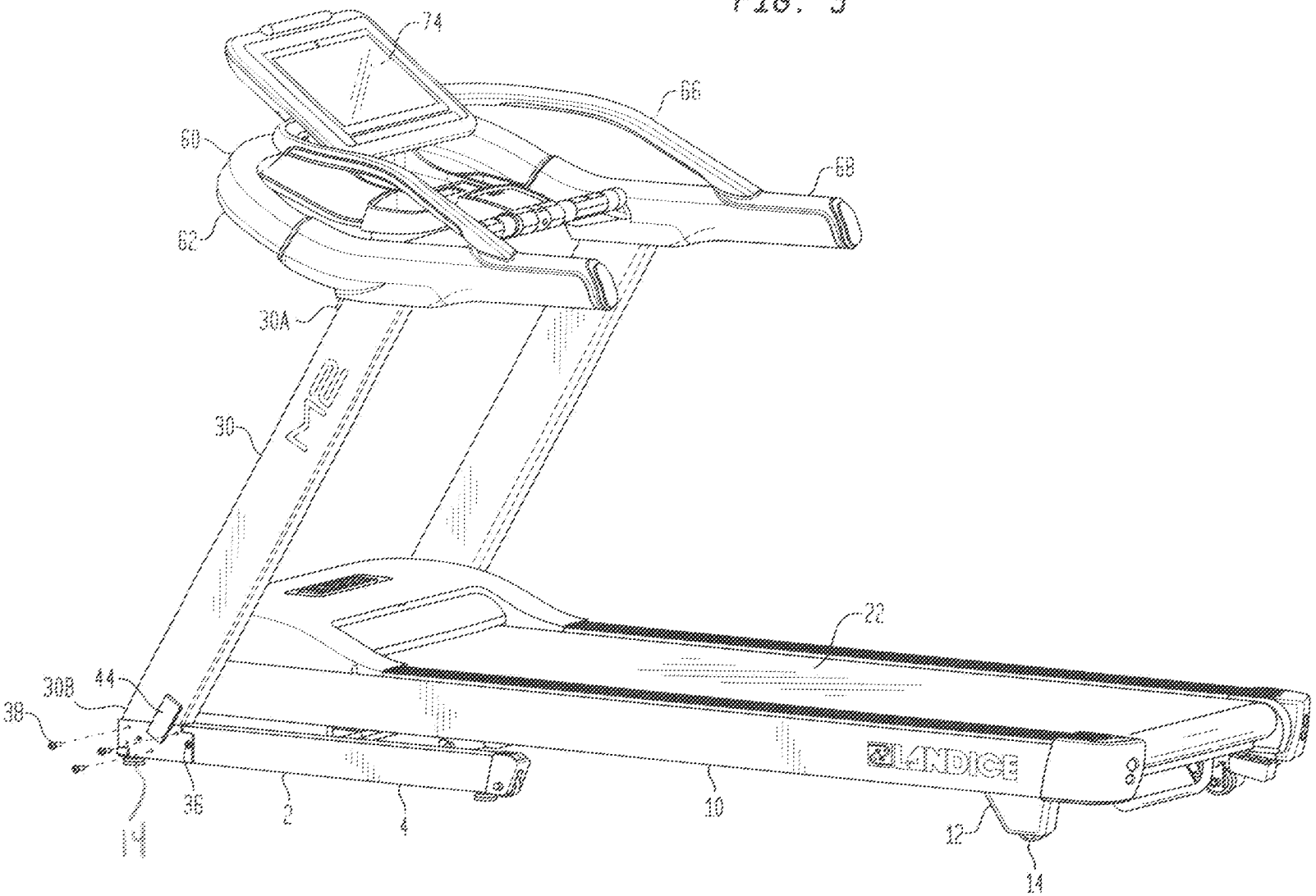
FIG. 5 is an isometric view of a treadmill in an assembled configuration in accordance with one embodiment of the present invention.

As depicted in FIG. 5, the treadmill 100, is now in an assembled configuration. The top assembly 60 being securely fastened to upright arms 30 at their distal end 30A and to support base 2 at their proximal end 30B. An angle θ1 between the upright arms 30 and the belt 22 and support base 2, which are colinear, is established at between about 42 degrees and about 62 degrees. Preferably the angle θ1 is about between about 50 degrees and about 54 degrees. In one embodiment, the angle θ1 is about 52 degrees. Prior to the assembly process, the angle θ (See e.g. FIG. 2) between the bottom surface 62A of the bridge 62 and the belt 22 and support base 2 is about 90 degrees, where as in the assembled configuration (e.g., FIGS. 5-6), the bottom surface 68A of the handrail 68 is substantially parallel with the belt 22 and support base 2 with respect to axis A. Substantially parallel as defined herein meaning between about +/− about 5 degrees.

Figure 6:
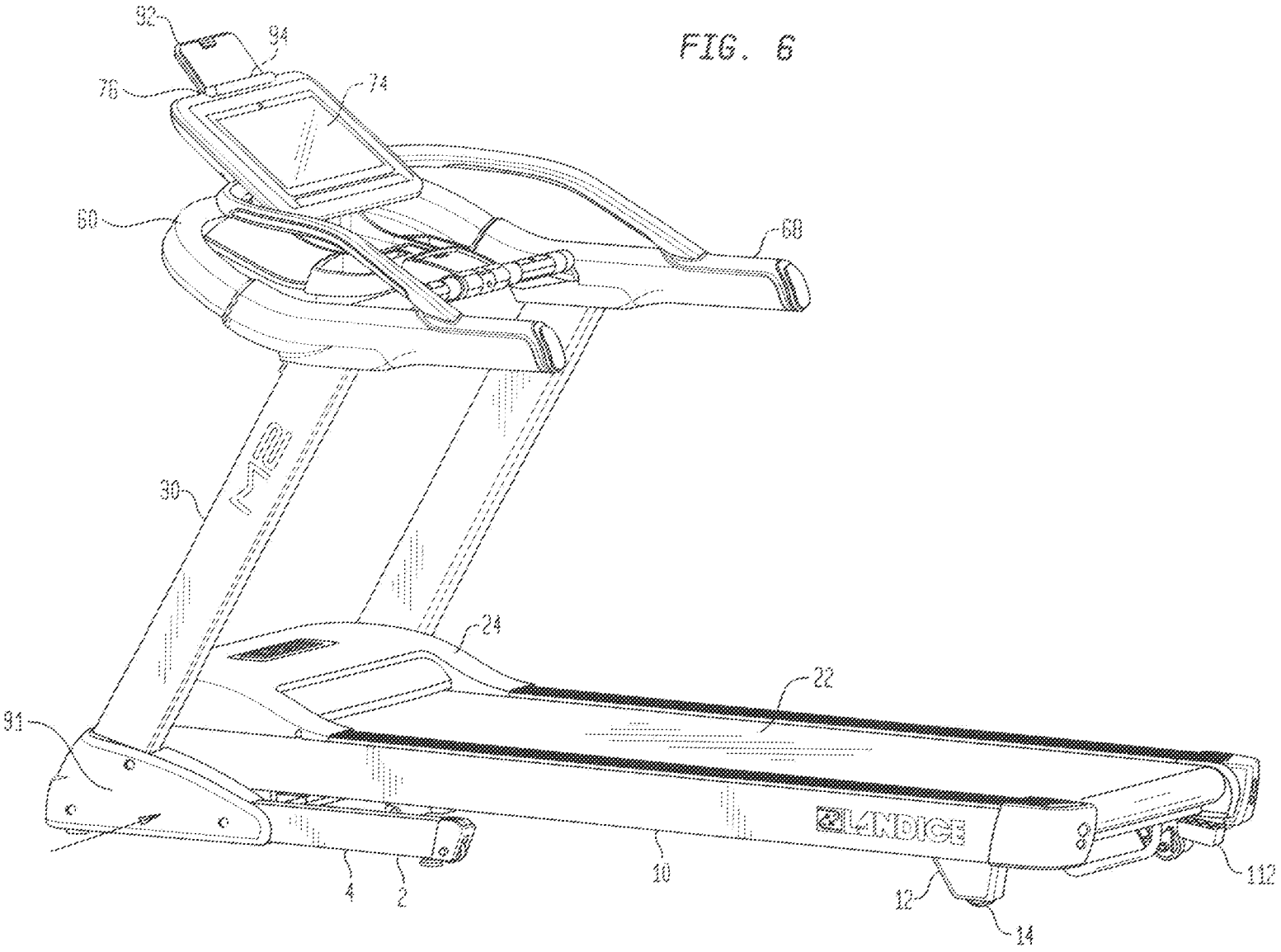
FIG. 6 is another isometric view of a treadmill in an assembled configuration in accordance with an embodiment of the present invention.
Figure 7:
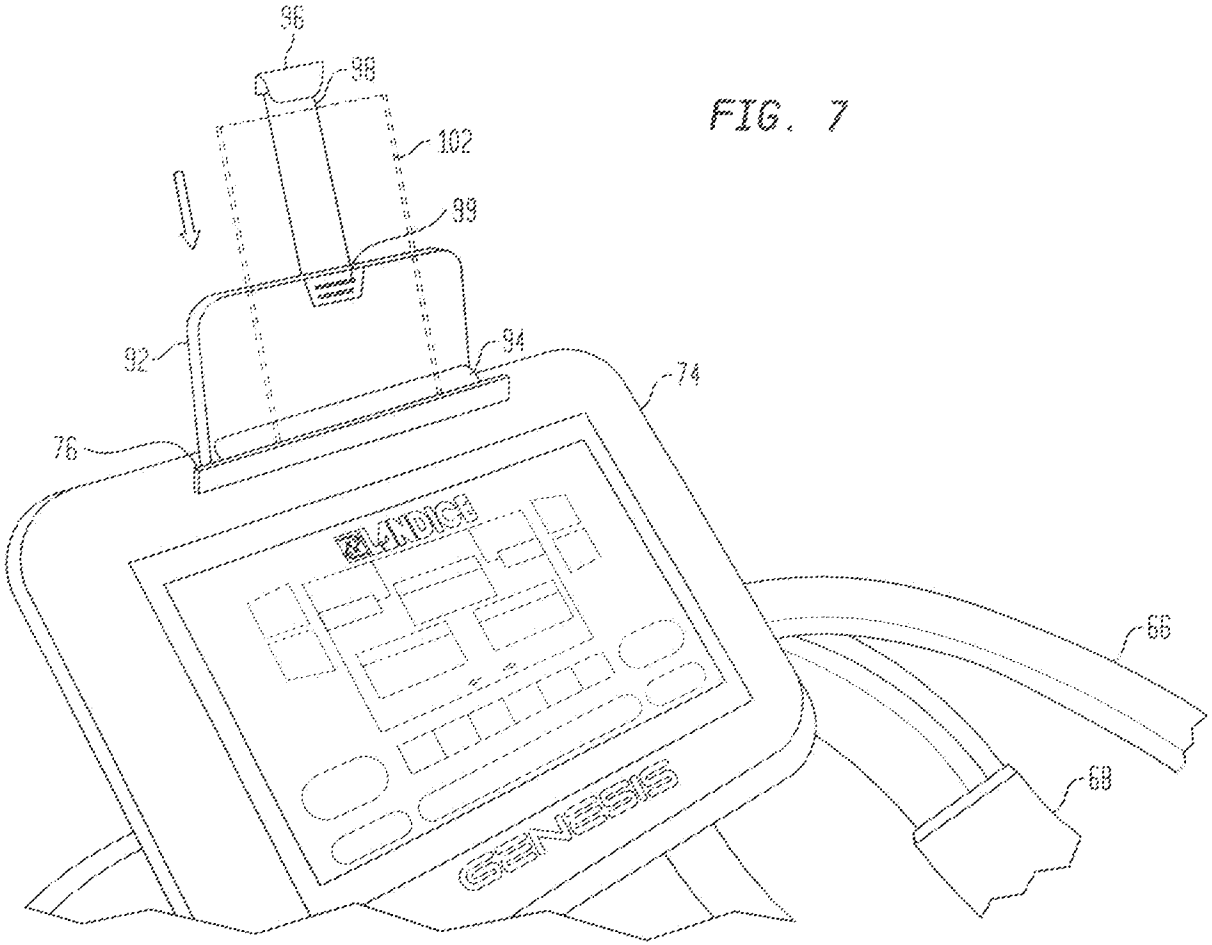
FIG. 7 is a detail view depicting some of the elements of the treadmill in accordance with FIG. 5.
Figure 8:
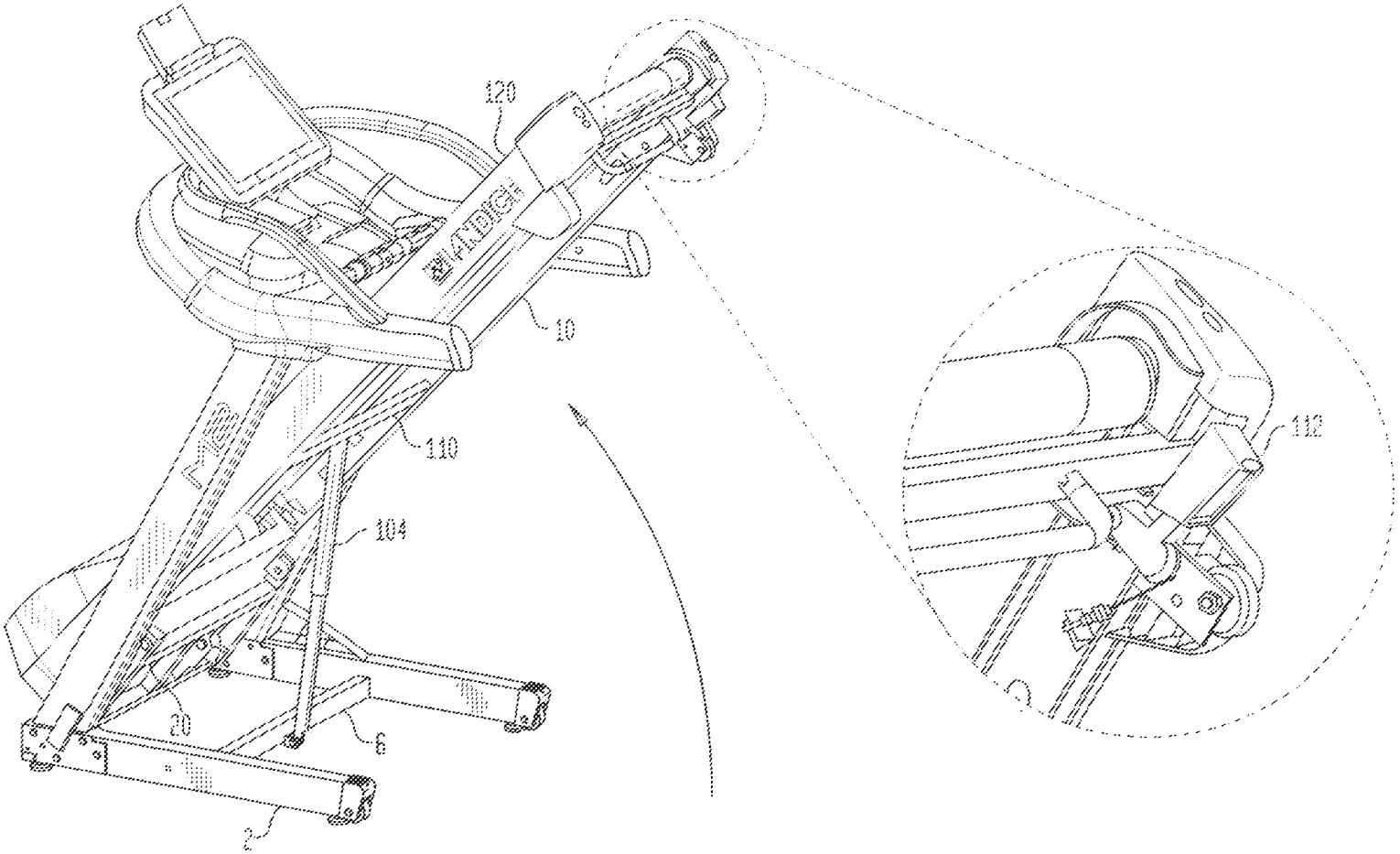
FIG. 8 is an isometric view of a treadmill in a storage configuration including details of the release mechanism in accordance with an embodiment of the present invention.

Referring now to FIGS. 6-7, the treadmill 100 is in an assembled configuration. Covers 91 can be installed to protected the joint between the support base 2 and the upright arms 30. The covers 91 can be snap fit, or attached with fasteners for ease of access for disassembly as required. Phone holder 92 includes a phone rest 94 and can be fit into phone holder slot 76 of control console 74. The phone holder 92 includes a rectangular clip 96 which is attached to one or more elastic members 98. In the stowed condition, the clip 96 fits into a recess 99 in the phone holder 92. The clip 96 can be moved to elongate the elastic members 98 such that the clip 96 captures a portion of a cell phone or tablet 102, thereby applying a compressive force which holds the phone or tablet 102 in place between the phone rest 94 and the clip 96. When the phone or tablet 102 is removed, the clip 96 can easily and elastically retracted and can fit back into its original position in recess 99.

Referring to FIGS. 8-11, the treadmill 100 includes features which allow for easy mechanically assisted folding of the structure for storage. A telescoping hydraulic cylinder assembly 104 is connected to the crossmember 6 of the support base 2. The crossmember can include two tangs 106 having a central aperture for connecting to one end of the cylinder 104 using a fastener 108 (See FIG. 9B). The other end of the cylinder assembly 104, is similarly connected to another crossmember 110 which is attached to long members 10 located under the belt 22.

Figure 9A:
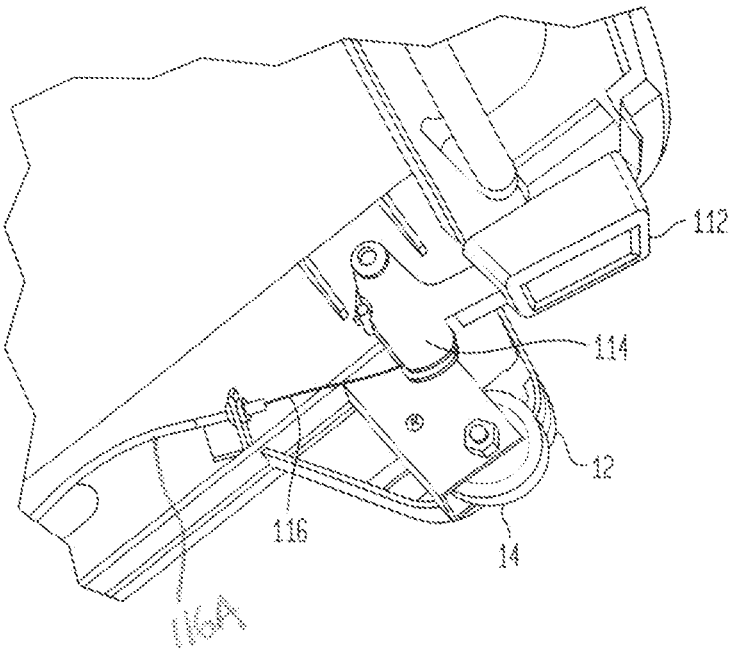
FIG. 9A is a detail of some of the elements of the treadmill shown in FIG. 5.
Figure 9B:
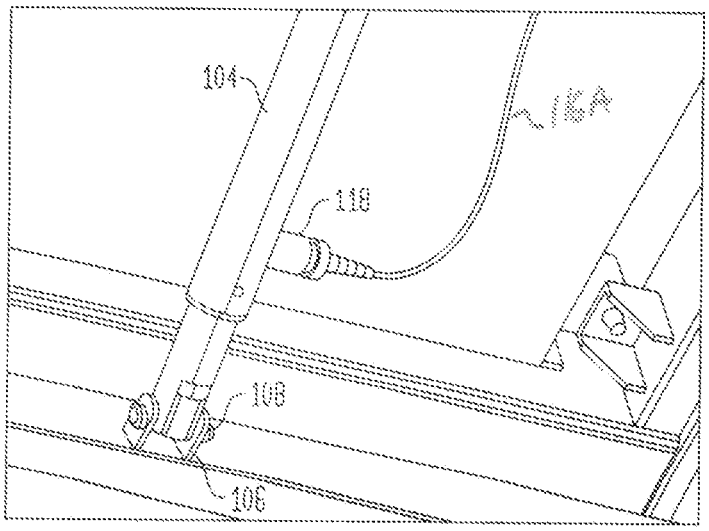
FIG. 9B is another detail of some of the elements of the treadmill shown in FIG. 5.

As shown in FIGS. 9A and 9B, a release pedal 112 is held in a locked position by pivot tab 114. When a user depresses the pedal 112 (e.g., using a hand or foot), the pedal rotates and actuates a cable 116. The cable can include a protective jacket 116A to protect it from damage during assembly or disassembly. The cable 116 is also connected to a release pin 118 located on the cylinder assembly 104. When the pedal 112 is depressed or rotated, the cable 116 translates a distance thereby moving the release pin 118 from an unreleased to a released position. In the unreleased position the telescoping hydraulic cylinder assembly 104 is stowed in a compressed position. When the release pin 118 removed, the telescoping hydraulic cylinder assembly 104 moves in a safe and controlled manner to the released uncompressed position, thereby causing the entire bed assembly 120 to move into a folded configuration for storage. When in the folded configuration the treadmill 100 can be easily moved by rotating it on the wheels or rollers 14.

Figure 10B:
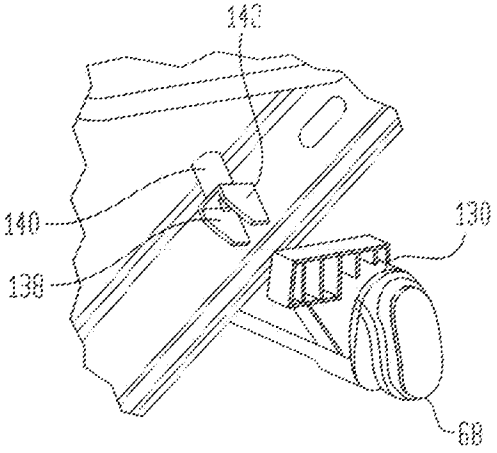
FIG. 10B is a detail view of some of the elements of the treadmill shown in FIG. 10A.
Figure 10C:
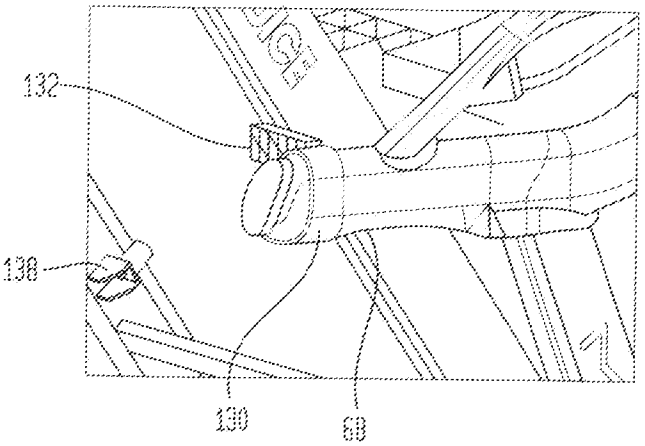
FIG. 10C is another detail view of some of the elements of the treadmill shown in FIG. 10A.
Figure 10A:
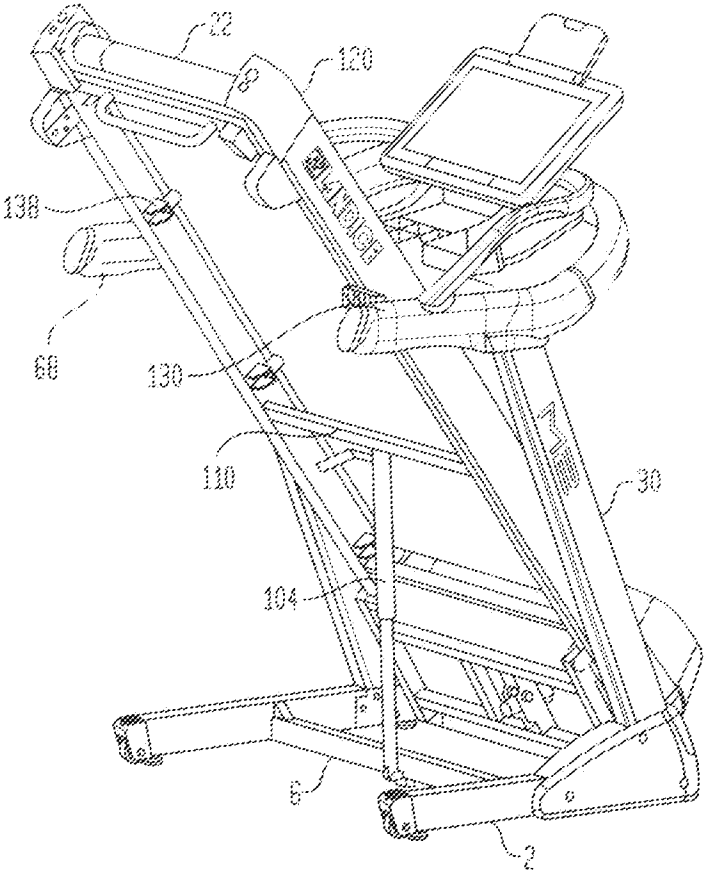
FIG. 10A is another isometric view of a treadmill in a storage configuration including details of the release mechanism in accordance with an embodiment of the present invention.
Figure 11:
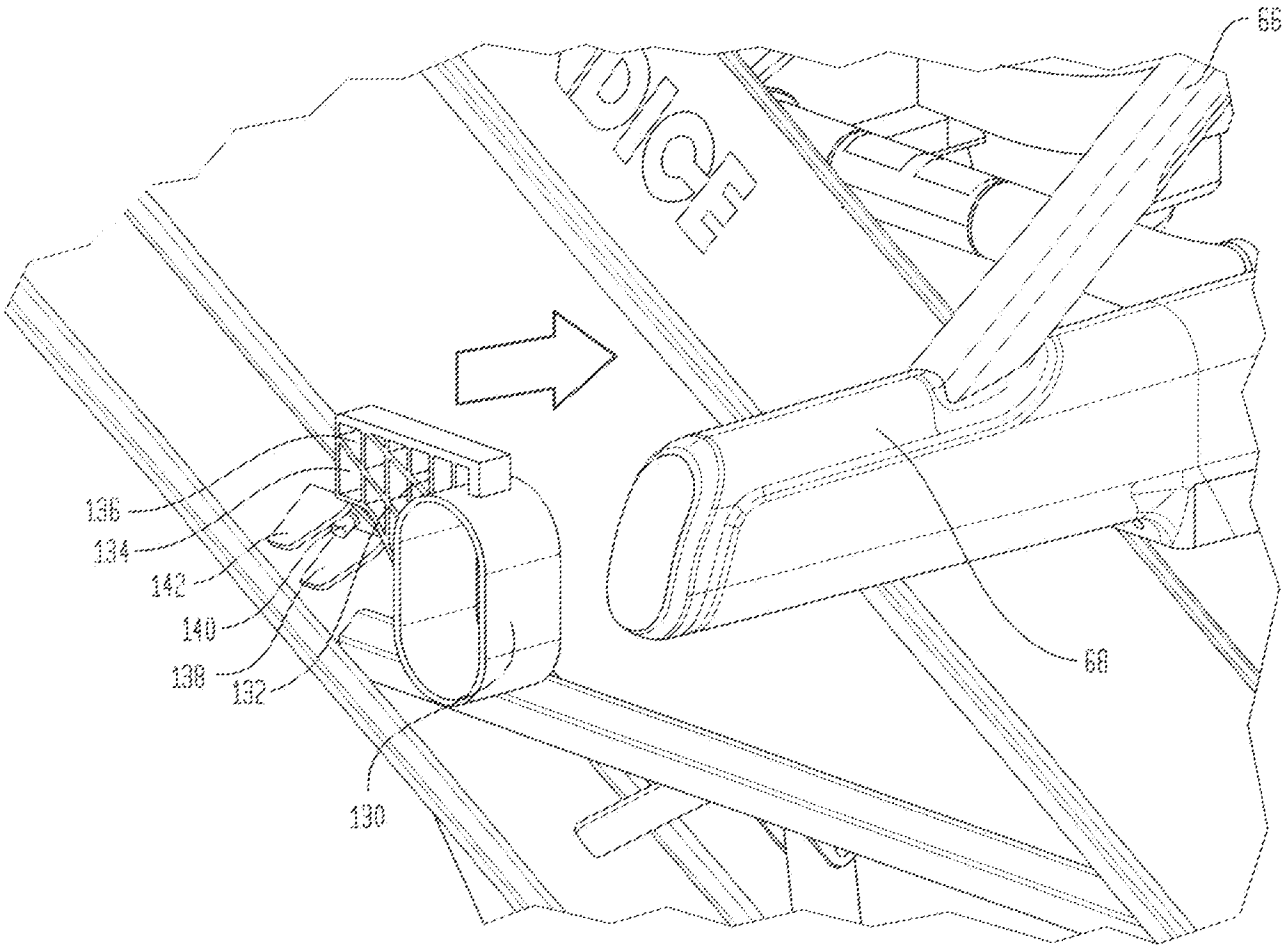
FIG. 11 is a detail view of some of the elements of the treadmill shown in FIG. 10A.

Referring to FIGS. 10 and 11, the treadmill can include a novel safety mechanism to prevent accidental release of the bed 120 in the folded condition. In this position, the telescoping hydraulic cylinder assembly 104 is completely extended to provide support between the crossmember 6 and crossmember 110. Safety collar 130 can be oval an is shaped to removably fit over the end of the left or right lower handrails 68. The collar 130 includes a rectangular box structure 132 including individual chambers 134 formed by walls 136. An adjustable stop 138 including a cylindrical portion 140 and spaced apart fins 142 can be used to stabilize the bed 120 in the folded configuration. The safety collar 130 is fitted over the handrail 68 such that the box structure 132 interferes with the ability of the bed 120 to move. The adjustable stop 138 can be fitted into any of the chambers 134, thereby capturing or blocking with the long members 10 of the bed 120 to prevent movement or collapse of the bed. One or more safety collars 130 may be used, for example one on each right and left handle 68 during storage. The collars 130 can be easily removed to allow the bed 120 to move in a safe and controlled manner to the deployed or assembled position. The motion is limited by a predetermined force required to move telescoping hydraulic cylinder assembly 104 back to a compressed position.

While the present disclosure has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

LIST OF REFERENCE NUMBERS

100 treadmill
2 support base
4 support longitudinal members
6 crossmember
A long axis
8 platform
10 platform longitudinal members
12 feet
14 wheel
20 motor
22 belt
24 motor cover
30 upright arms
32 pivot brackets
34 flanges
36 pivot fastener
38 fasteners
39 spring loaded pin
39A pin aperture
40 apertures base
42 apertures flange
44 support member
60 top assembly
62 bridge
62A bottom surface of bridge
64 ergo bar
66 upper handrails
68 lower handrails
68A bottom surface of lower handrail
72 mini pod assembly
74 control console
76 phone holder slot
78 pivot flanges
80 central aperture
82 tang
84 bracket
86 aperture bracket
88 aperture upright arm
θ angle between upright arm and handrail
90 beveled end
30A distal end of arm
30B proximal end of arm
θ1 angle between the upright arms and belt or axis A.
89 fastener
91 covers
92 phone holder
94 phone rest
96 clip
99 recess
98 elastic members
102 phone or tablet
104 cylinder assembly
106 tangs
108 fastener
110 crossmember
112 release pedal
114 pivot tab
116 cable
116A jacket
118 release pin
120 bed assembly
130 safety collar
132 box
134 chamber
136 walls
138 stop
140 cylindrical portion
142 finned portion

What is claimed is:

1. A treadmill, the treadmill comprising:

a support base including a pair of first support members and at least one crossmember disposed between the first support members, the first support members including a first plurality of apertures and a first pivot aperture;

a platform including second support members for supporting a belt, the belt being driven by a controllable motor, the platform having one or more feet attached thereto and a longitudinal axis A;

a pair of upright arms, each arm having a distal end and a proximal end; the distal end being attached to a third support member and a pivot bracket including a flanged portion; the flanged portion including a second plurality of apertures and a second pivot aperture, wherein the first and second pivot apertures are aligned to house a first pivot fastener therethrough thus forming a pivot joint between the first support members and the upright arms allowing for rotation of the upright arms though a predetermined angle θ for installation of a plurality of fasteners through the aligned first and second plurality of apertures; the proximal end of the upright arms including a tang and an attachment aperture therethrough; and a top assembly including a bridge connected to an upper and a lower handrail, an ergo bar, a central minipod assembly and a control console, the lower handrails including a bottom portion having pivot flanges, each pivot flange having a first aperture therethrough and a bracket having a second aperture therethrough, wherein a second pivot fastener is installed to connect the attachment tang of the upright arms with the pivot flange of the top assembly thus allowing the top assembly to be rotated through a predetermined angle θ1 for fixed installation of the top assembly.

2. The treadmill of claim 1, wherein the angle θ is between about 42 degrees and about 62 degrees.

3. The treadmill of claim 2, wherein the angle θ is between about 50 degrees and about 54 degrees.

4. The treadmill of claim 3, wherein the angle θ is about 52 degrees.

5. The treadmill of claim 1, wherein the angle θ1 is between about 80 degrees and about 100 degrees.

6. The treadmill of claim 5, wherein the angle θ1 is about 90 degrees.

7. The treadmill of claim 1, further including a phone holder having a phone rest, and a rectangular clip connected to an elastic member, the elastic member being anchored and fit in a recess, wherein a phone or a tablet can be releasably retained by the elastic members between the rectangular clip and the phone rest.

8. The treadmill of claim 1, further including a cylinder assembly, the cylinder assembly being pivotally attached to a support base crossmember and a bed assembly crossmember, the cylinder assembly includes a release pin connected to cable, wherein the cable can be actuated by depressing a pedal to translate the release pin and causing the cylinder assembly to expand thereby raising a bed assembly to a storage configuration.

9. The treadmill of claim 8, further including a safety collar; the safety collar having an aperture sized to fit on the lower handrail, a box portion including at least one chamber, and a stop including a cylindrical portion and a finned portion, wherein the safety collar can be installed on the lower handrail such that the stop interferes with and prohibits movement or collapse of the bed assembly while in the storage configuration.

10. The treadmill of claim 9, wherein a first safety collar is installed on a right lower handrail and a second safety collar is installed on a left lower handrail.

11. A method of treadmill assembly and storage comprising the steps of:

placing a preassembled support base including a pair of first support members and at least one crossmember disposed between the first support members, the first support members including a first plurality of apertures and a first pivot aperture, the support base being connected to a platform including second support members for supporting a belt, the belt being driven by a controllable motor, the platform having one or more feet attached thereto and a longitudinal axis A;

rotating a pair of upright arms though a predetermined angle θ, each arm having a distal end and a proximal end; the distal end being attached to a third support member and a pivot bracket including a flanged portion, the flanged portion including a second plurality of apertures and a second pivot aperture, wherein the first and second pivot apertures are aligned to house a first pivot fastener therethrough thus forming a pivot joint between the first support members and the upright arms;

installing of a plurality of fasteners through the aligned first and second plurality of apertures; the proximal end of the upright arms including a tang and an attachment aperture therethrough; and rotating a top assembly through a predetermined angle θ1, the top assembly including a bridge connected to an upper and a lower handrail, an ergo bar, a central minipod assembly and a control console, the lower handrails including a bottom portion having pivot flanges, each pivot flange having a first aperture therethrough and a bracket having a second aperture therethrough, wherein a second pivot fastener is pre-installed to connect the attachment tang of the upright arms with the pivot flange of the top assembly thus allowing the top assembly to be rotated for fixed installation of the top assembly.

12. The method of claim 11, wherein the angle θ is between about 42 degrees and about 62 degrees.

13. The method of claim 11, wherein the angle θ1 is between about 80 degrees and about 100 degrees.

14. The method of claim 11, wherein the angle θ is between about 42 degrees and about 62 degrees and the angle θ1 is between about 80 degrees and about 100 degrees.

15. The method of claim 11, further including the step of a releasably retaining a phone or a tablet in phone holder, the phone holding having a phone rest, and a rectangular clip connected to an elastic member, the elastic member being anchored and fit in a recess, wherein a phone or a tablet is releasably retained by the elastic members between the rectangular clip and the phone rest.

16. The method of claim 11, further including the step of raising a bed assembly to a storage configuration using a cylinder assembly, the cylinder assembly being pivotally attached to a support base crossmember and a bed assembly crossmember, the cylinder assembly includes a release pin connected to cable, wherein the cable can be actuated by depressing a pedal to translate the release pin and causing the cylinder assembly to expand and raise the bed assembly to a storage configuration.

17. The method of claim 16 further including the step of installing a safety collar, the safety collar having an aperture sized to fit on the lower handrail, a box portion including at least one chamber, and a stop including a cylindrical portion and a finned portion, wherein the safety collar can be installed on the lower handrail such that the stop interferes with and prohibits movement or collapse of the bed assembly while in the storage configuration.

18. The method of claim 17, wherein a first safety collar is installed on a right lower handrail and a second safety collar is installed on a left lower handrail.

19. The method of claim 16, including the step of lowering the bed assembly to a user ready assembled configuration by allowing the cylinder assembly to contract thereby lowering the bed assembly to the assembled configuration.

20. The method of claim 17, including the steps of removing the safety collar and lowering the bed assembly to a user ready assembled configuration by allowing the cylinder assembly to contract thereby lowering the bed assembly to the user ready assembled configuration.

* * * * *